US005168114A

United States Patent [19]

Enget

[11] Patent Number: 5,168,114

[45] Date of Patent: Dec. 1, 1992

[54] AUTOMATIC GUN SAFETY DEVICE

[76] Inventor: Jerome M. Enget, 535 N. Central, Crookston, Minn. 56716

[21] Appl. No.: 808,177

[22] Filed: Dec. 13, 1991

[51] Int. Cl.[5] ..... F41A 17/06

[52] U.S. Cl. ..... 42/70.01; 42/70.06

[58] Field of Search ..... 42/70.01, 70.11, 70.06

[56] References Cited

U.S. PATENT DOCUMENTS

| | | | |
|---|---|---|---|
| 4,003,152 | 1/1977 | Barker et al. | 42/70.01 |
| 4,154,014 | 5/1979 | Smith | 42/70.01 |
| 4,488,370 | 12/1984 | Lemelson | 42/70.01 |
| 4,563,827 | 1/1986 | Heltzel | 42/70.01 |
| 4,682,435 | 7/1987 | Heltzel | 42/70.01 |
| 5,016,376 | 5/1991 | Pugh | 42/70.11 |
| 5,022,175 | 6/1991 | Oncke et al. | 42/70.11 |
| 5,062,232 | 11/1991 | Eppler | 42/70.11 |
| 5,068,989 | 12/1991 | Martin | 42/70.01 |

FOREIGN PATENT DOCUMENTS 3446019 6/1986 Fed. Rep. of Germany ..... 42/70.11

*Primary Examiner*—Michael J. Carone

*Attorney, Agent, or Firm*—Richard L. Miller

[57] ABSTRACT

An automatic gun safety device is provided which consists of a mechanism for transmitting radio signals. Another mechanism is built into a firearm for receiving the radio signals. A solenoid is electrically connected to the receiving mechanism and is normally in engagement with a trigger of the firearm, so that the firearm can only be fired, when the transmitting mechanism is within range of the receiving mechanism and a properly coded signal is being received by the receiving mechanism. The receiving mechanism which is housed within the fire arm will activate the solenoid to disengage with the trigger of the firearm, allowing the trigger to be depressed to fire the firearm.

10 Claims, 2 Drawing Sheets

FIG. 1
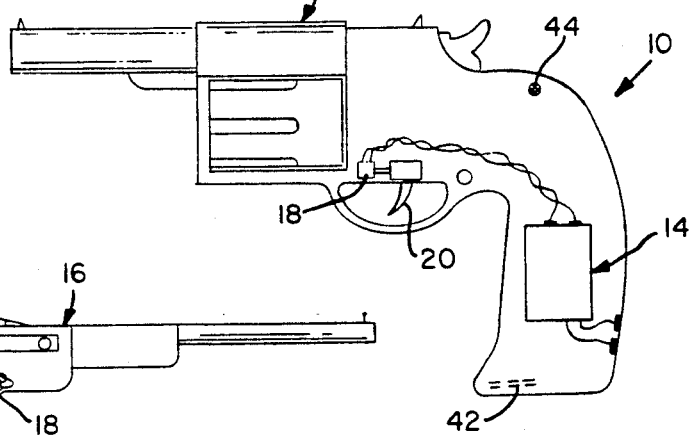
FIG. 2
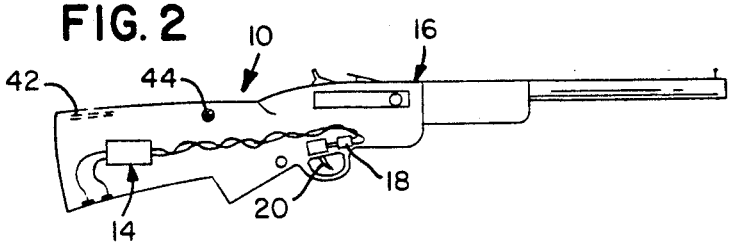
FIG. 3
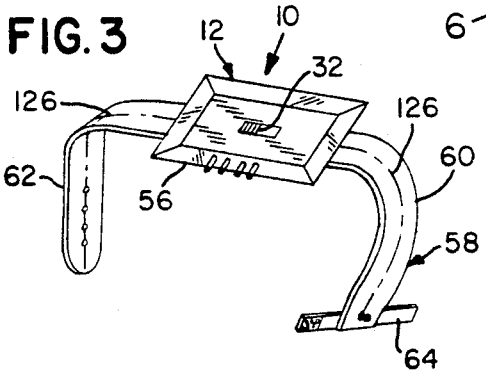
FIG. 4
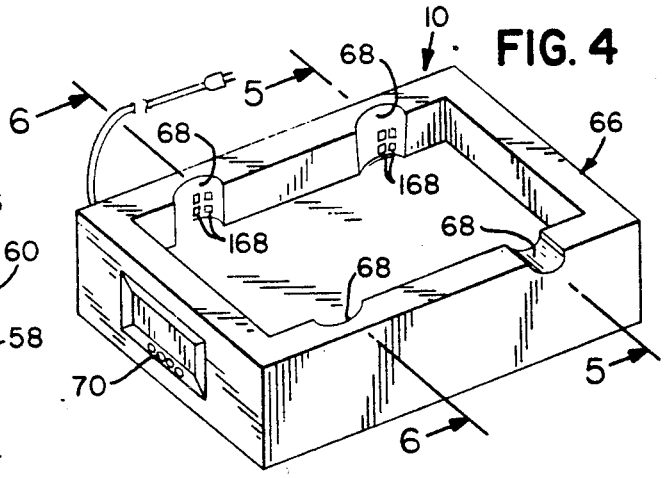
FIG. 5
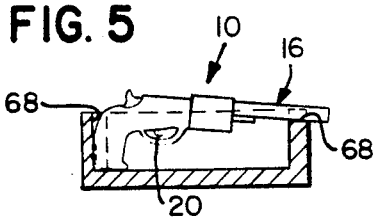
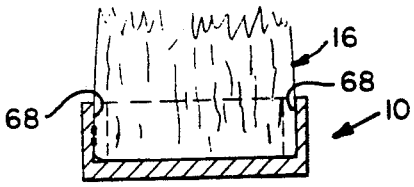
FIG. 6
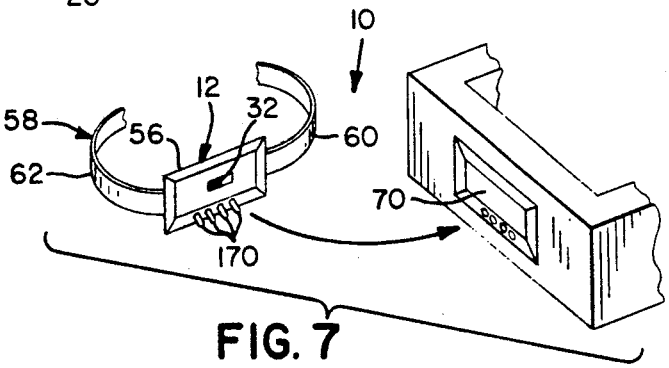
FIG. 7

AUTOMATIC GUN SAFETY DEVICE

BACKGROUND OF THE INVENTION

The instant invention relates generally to safety locks for firearms and more specifically it relates to an automatic gun safety device which is particularly useful for child safety, police officers, burglary, hunting accident, and so on.

Numerous safety locks for firearms have been provided in the prior art that are adapted to include mechanism to prevent the accidental or unauthorized operation of the firearms. For example, U.S. Pat. Nos. 3,707,796 to Bielfeldt; 4,730,538 to Zamacoln and Des. 260,548 to Holland all are illustrative of such prior art. While these units may be suitable for the particular purpose to which they address, they would not be as suitable for the purpose of the present invention as hereafter described.

SUMMARY OF THE INVENTION

A primary object of the present invention is to provide an automatic gun safety device that will overcome the shortcomings of the prior art devices.

Another object is to provide an automatic gun safety device that utilizes an electronically operated solenoid to release the trigger of the gun so that the gun can be fired.

An additional object is to provide an automatic gun safety device in which the electronically operated solenoid is activated by a radio controlled signal between a coded transmitter carried by a person and a coded receiver built into the gun, so that the gun can only be fired when the coded transmitter comes within the required range of the coded receiver.

A further object is to provide an automatic gun safety device that is simple and easy to use.

A still further object is to provide an automatic gun safety device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic view of a typical hand gun with the receiving mechanism of the instant invention installed therein;

FIG. 2 is a diagrammatic view of a typical rifle with the receiving mechanism of the instant invention installed therein;

FIG. 3 is a diagrammatic perspective view of a wrist holder with the transmitting mechanism of the instant invention installed therein;

FIG. 4 is a diagrammatic perspective view of a housing with the combination charger and encoder mechanism of the instant invention installed therein;

FIG. 5 is a diagrammatic cross sectional view taken on line 5—5 of FIG. 4, illustrating a hand gun installed so that the receiving mechanism can be charged and encoded;

FIG. 6 is a diagrammatic cross sectional view taken on line 6—6 of FIG. 4, with parts broken away, illustrating a rifle installed so that the receiving mechanism can be charged and encoded;

FIG. 7 is a perspective view with parts broken away illustrating the wrist holder about to be installed in the housing with the combination charger and encoder mechanism of the instant invention.

DETAILED DESCRIPTION OF THE PREFERRED EMBODIMENTS

Figure 8:
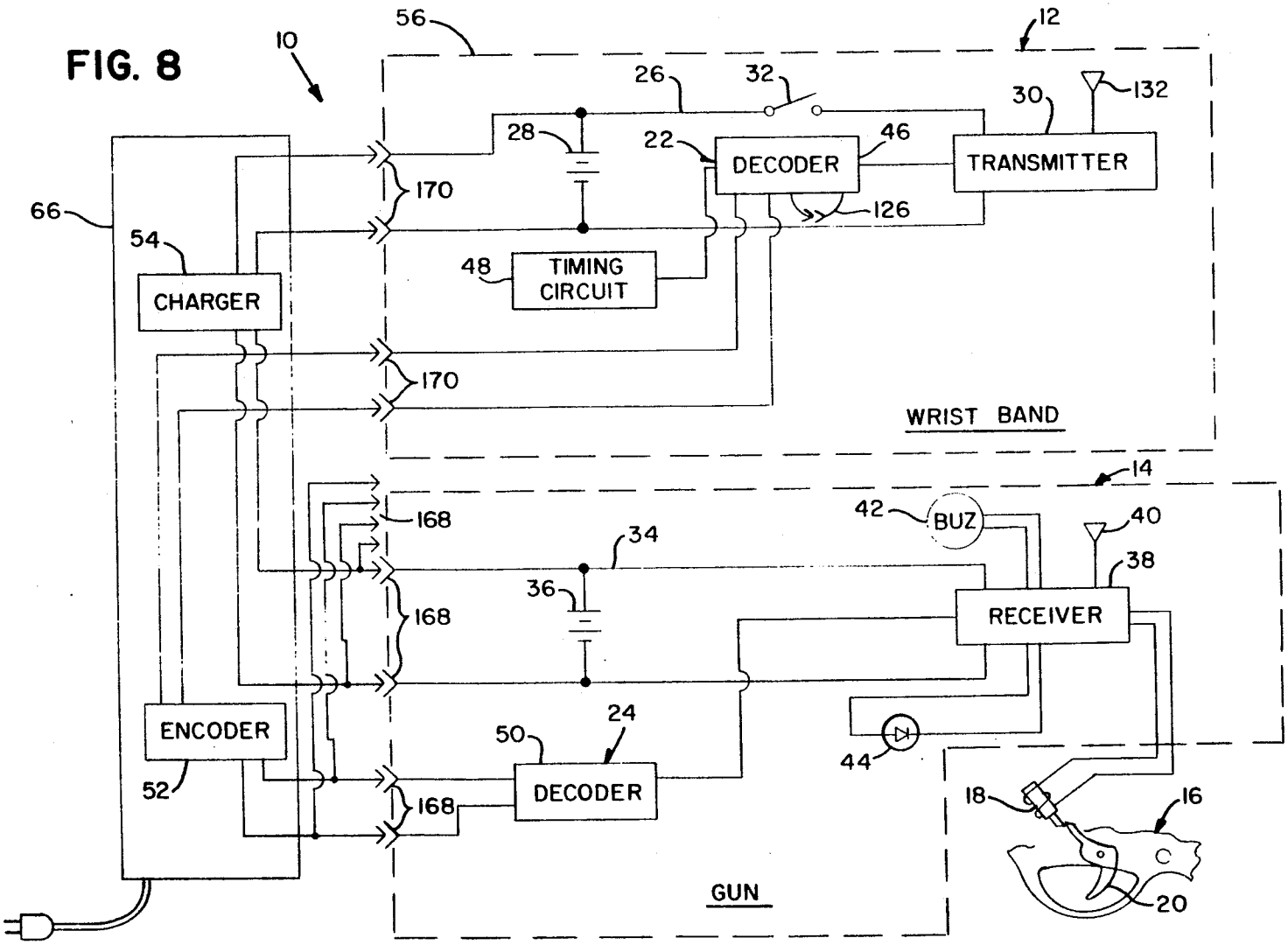
FIG. 8 is a schematic block diagram of the instant invention.

Turning now descriptively to the drawings, in which similar reference characters denote similar elements throughout the several views, the Figures illustrate an automatic gun safety device 10 which consists of a sending mechanism 12 for transmitting radio signals. Another mechanism 14 is built into a firearm 16, such as a hand gun or rifle, for receiving the radio signals. A solenoid 18 is electrically connected to said receiving mechanism 14 and is normally in engagement with a trigger 20 of the firearm 16, so that the firearm 16 can only be fired, when the transmitting mechanism 12 is within range of the receiving mechanism 14, the receiving mechanism 14 will activate the solenoid 18 to disengage with the trigger 20 of the firearm 16, allowing the trigger 20 to be depressed to fire the firearm 16.

The automatic gun safety device 10, further includes a mechanism 22 for coding the transmitting mechanism 12 and a mechanism 24 for coding the receiving mechanism 14, so that only properly encoded radio signals from the transmitting mechanism 12 will be received and processed by the receiving mechanism 14 to permit the appropriate firearm 16 to be fired.

The transmitting mechanism 12, carried on a wrist worn bracelet 58, has an antenna 132, and includes an electric circuit 26 with rechargeable battery 28 for powering a transmitter 30. An on/off switch 32 connected to the electric decoder circuit 46 so if the switch 32 is turned off the wrist band will need to be encoded again.

The receiving mechanism 14 includes an electric circuit 34, a rechargeable battery 36 connected to the electric circuit 34, a receiver 38 connected to the electric circuit 34, a solenoid 18 and an antenna 40 connected to the receiver 38 to receive the coded radio signals from the transmitter 30, so that the receiver 38 can activate the solenoid 18.

The receiving mechanism 14 further includes a buzzer 42 connected to the receiver 38 to indicate when the battery 36 is discharge and a light emitting diode 44 connected to the receiver 38 to indicate that the solenoid 18 is disengaged from the trigger 20, so that the firearm 16 can be fired.

The coding mechanism 22 for the transmitting mechanism 12 includes a decoder 46 connected to the transmitter 30, which is controlled by timing circuit 48 connected to the decoder 46.

The automatic gun safety device 10 further includes an encoder 52 which can be plugged simultaneously into the decoder 46 in the transmitting mechanism 12 and the decoder 50 in the receiving mechanism 14 to encode the decoders 46 and 50. The automatic gun safety device 10 further includes a charger which can be plugged simultaneously into the electric circuit 26 in the transmitting mechanism 12 to charge the battery 28 and the electric circuit 34 in the receiving mechanism 14 to charge the battery 36. The transmitting mechanism 12 further includes a housing 56 to carry all of the electric elements of said transmitting mechanism 12 therein and wrist band 58 connected the housing 56. The wrist band 58 is to be worn on a wrist of a person using the firearm, thereby making the transmitting mechanism 12 portable. The wrist band 58 includes a first segment 60, having a portion of the electric link 126 therein, a second segment 62 having a portion of the electric link 126 therein and a closure member 64 on the first segment 60. The closure member 64 will secure the wrist band 58 about the wrist of the person and close the electric link 126, so that when the wrist band 58 is opened and removed from the wrist, the electric link 126 will be open to disengage the transmitting mechanism 12 and needs to be encoded again. A receptacle 66 is to carry the encoder 52 and charged 54 therein. Any suitable set of contact pairs 168 are incorporated in structure 68 of the receptacle 66, for installing said firearm 16 therein, so that said receiving mechanism 14 can be encoded and charged. Another suitable set of contacts pairs 170 are incorporated structure 70 is in the receptacle 66 for installing the housing 56 therein, so that the transmitting mechanism 12 can be encoded and charged. The timing circuit 48 requires that the wrist band be connected within a set period typically one minute after being removed from the receptacle 66 it will need to be encoded again.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An automatic gun safety device which comprises:

a) transmitting means for radio signals;

b) means for coding said transmitting means; wherein said transmitting means includes:

i) an electric circuit having a set of contacts pairs connected their to for permitting charging and encoding of components connected their to;

ii) a rechargeable battery connected to said electric circuit;

iii) a transmitter connected to said electric circuit;

iv) at least one on/off means connected to a decoder which if turned of will need to be encoded again; and v) an antenna connected to said transmitter;

c) means built into a firearm, for receiving the radio signals;

d) means for coding said receiving means, so that only properly encoded radio signals from said transmitting means will be received and processed by said receiving means; and e) a solenoid electrically connected to said receiving means and normally in an engagement with a trigger of the firearm, so that the firearm cannot be fired, whereby when said transmitting means is within range of said receiving means, said receiving means will activate said solenoid to disengage with the trigger of the firearm, allowing the trigger to be depressed to fire the firearm.

2. An automatic gun safety device as recited in claim 1, wherein said receiving means includes:

a) an electric circuit having a set of contacts pairs connected their to for permitting charging and encoding of components connected their to;

b) a rechargeable battery connected to said electric circuit;

c) a receiver connected to said electric circuit and said solenoid; and d) an antenna connected to said receiver to receive the coded radio signals from said transmitter, so that said receiver can activate said solenoid.

3. An automatic gun safety device as recited in claim 2, wherein said receiving means further includes:

a) a buzzer connected to said receiver to indicate when said battery is discharged; and b) a light emitting diode connected to said receiver to indicate that said solenoid is disengaged from the trigger, so that the firearm can be fired.

4. An automatic gun safety device as recited in claim 3, wherein said coding means for said transmitting means includes:

a) a timing circuit connected to said decoder; and b) said decoder connected to said transmitter.

5. An automatic gun safety device as recited in claim 4, wherein said coding means for said receiving means includes a decoder connected to said timing circuit, in said transmitting means.

6. An automatic gun safety device as recited in claim 5, further including an encoder which can be plugged simultaneously into said decoder in said transmitting means and said decoder in said receiving means, to encode said decoders.

7. An automatic gun safety device as recited in claim 6, further including a charger which can be plugged simultaneously into said electric circuit in said transmitting means to charge said battery and said electric circuit in said receiving means to charge said battery.

8. An automatic gun safety device as recited in claim 7, wherein said transmitting means further includes:

a) a housing to carry all of the electric elements of said transmitting means therein;

b) a wrist band connected to said housing so that said wrist band can be worn on a wrist of a person using the firearm, thereby making said transmitting means portable.

9. An automatic gun safety device as recited in claim 8, wherein said wrist band includes:

a) a first segment having a portion of said electric circuit therein;

b) a second segment having a portion of said electric circuit therein; and c) a closure member on said first segment to secure said wrist band about the wrist of the person and close said electric circuit, so that when said wrist band is opened and removed from the wrist, said electric circuit will be open to disengage said transmitting means.

10. An automatic gun safety device as recited in claim 9, further including:

a) a receptacle to carry said encoder and said charger therein;

b) means in said receptacle for installing said firearm therein, so that said receiving means can be encoded and charged; and c) means in said receptacle for installing said housing therein, so that said transmitting means can be encoded and charged.

* * * * *